US011344773B2

(12) United States Patent
Aramaki

(10) Patent No.: US 11,344,773 B2
(45) Date of Patent: May 31, 2022

(54) GOLF CLUB HEAD AND METHOD FOR MANUFACTURING SAME

(71) Applicant: Sumitomo Rubber Industries, Ltd., Kobe (JP)

(72) Inventor: Tomotaka Aramaki, Kobe (JP)

(73) Assignee: SUMITOMO RUBBER INDUSTRIES, LTD., Kobe (JP)

( * ) Notice: Subject to any disclaimer, the term of this patent is extended or adjusted under 35 U.S.C. 154(b) by 0 days.

(21) Appl. No.: 17/174,424

(22) Filed: Feb. 12, 2021

(65) Prior Publication Data

US 2021/0268345 A1 Sep. 2, 2021

(30) Foreign Application Priority Data

Feb. 13, 2020 (JP) ..... JP2020-022782

(51) Int. Cl.
*A63B 53/04* (2015.01)
*B24B 1/00* (2006.01)
*A63B 53/06* (2015.01)

(52) U.S. Cl.
CPC ..... *A63B 53/0433* (2020.08); *A63B 53/042* (2020.08); *A63B 53/0466* (2013.01); *A63B 53/06* (2013.01); *B24B 1/00* (2013.01)

(58) Field of Classification Search
CPC ..... A63B 53/0433; A63B 53/0466; A63B 53/042; A63B 53/06; A63B 53/0437; B24B 1/00
USPC ..... 473/324–350, 287–292
See application file for complete search history.

(56) References Cited

U.S. PATENT DOCUMENTS 6,960,141 B2 * 11/2005 Noguchi ..... A63B 53/0466 473/328
7,037,214 B2 * 5/2006 Nakahara ..... A63B 53/0466 473/345
7,128,664 B2 * 10/2006 Onoda ..... A63B 53/0466 473/347
7,189,165 B2 * 3/2007 Yamamoto ..... A63B 60/00 473/248
7,396,296 B2 * 7/2008 Evans ..... A63B 53/0466 473/344
7,435,190 B2 * 10/2008 Sugimoto ..... A63B 53/0466 473/345

(Continued)

FOREIGN PATENT DOCUMENTS

JP 5756305 B2 7/2015

*Primary Examiner* — Sebastiano Passaniti
(74) *Attorney, Agent, or Firm* — Birch, Stewart, Kolasch & Birch, LLP

(57) ABSTRACT

A golf club head includes a main body and a cover member. The main body is provided with a sole opening, and a receiving area therearound. The cover member integrally includes a crown cover and a sole cover. The sole cover has a peripheral edge portion on the receiving area. The sole portion is provided with a convexed or concaved shape-changing portion. The peripheral edge portion of the sole cover is located between the shape-changing portion and the back-side outer rim portion. The outer surface of the sole portion includes a first region on a side opposite of the shape-changing portion opposite to the back-side outer rim portion, and a second region on the same side of the shape-changing portion as the back-side outer rim portion. The second region includes a polished area formed from a part of the sole cover and a part of the main body.

9 Claims, 19 Drawing Sheets

(56) References Cited

U.S. PATENT DOCUMENTS

| | | | | |
|---|---|---|---|---|
| 7,549,933 | B2 * | 6/2009 | Kumamoto | A63B 60/02 473/329 |
| 7,691,008 | B2 * | 4/2010 | Oyama | A63B 60/02 473/345 |
| 7,988,565 | B2 * | 8/2011 | Abe | A63B 53/0466 473/328 |
| 8,926,450 | B2 * | 1/2015 | Takahashi | A63B 60/02 473/347 |
| 8,961,335 | B2 * | 2/2015 | Sugimoto | A63B 53/0466 473/332 |
| 9,931,547 | B2 * | 4/2018 | Lacey | A63B 53/04 |
| 10,569,143 | B2 * | 2/2020 | Funaki | A63B 53/0466 |
| 10,596,427 | B2 * | 3/2020 | Jertson | A63B 60/02 |
| 2002/0077195 | A1 * | 6/2002 | Carr | A63B 60/00 473/328 |
| 2002/0160858 | A1 * | 10/2002 | Lee | B29C 70/44 473/345 |
| 2005/0209024 | A1 * | 9/2005 | Oyama | A63B 53/0466 473/347 |
| 2005/0215354 | A1 * | 9/2005 | Kumamoto | A63B 53/0466 473/349 |
| 2010/0292029 | A1 * | 11/2010 | Rae | A63B 53/0466 473/345 |
| 2012/0225734 | A1 | 9/2012 | Nishio | |
| 2013/0102411 | A1 * | 4/2013 | Yamamoto | A63B 53/0466 473/345 |
| 2013/0116065 | A1 * | 5/2013 | Yamamoto | A63B 53/04 473/345 |
| 2019/0030401 | A1 * | 1/2019 | Hsiao | A63B 53/04 |
| 2019/0247724 | A1 * | 8/2019 | Shimahara | A63B 60/52 |
| 2021/0252347 | A1 * | 8/2021 | Aramaki | A63B 53/0466 |

* cited by examiner

GOLF CLUB HEAD AND METHOD FOR MANUFACTURING SAME

CROSS-REFERENCE TO RELATED APPLICATION

This application claims the benefit of foreign priority to Japanese Patent Application No. 2020-022782 filed 13 Feb. 2020 which is incorporated by reference in its entirety.

FIELD OF THE INVENTION

The present invention relates to a golf club head and a method for manufacturing the golf club head.

BACKGROUND OF THE INVENTION

The following Patent document 1 discloses a golf club head having a hollow therein. The golf club head comprises a club head main body made of a metal material and provided with an opening, and a cover member made of a fiber reinforced resin and closing the opening. The cover member extends from the crown portion to the sole portion while curving.

Patent document 1: Japanese Patent No. 5756305

SUMMARY OF THE INVENTION

Problems to be Solved by the Invention

By the way, when the cover member is fixed to the club head main body, the cover member may protrude outward from the finished surface of the sole portion due to a dimensional error or the like. Such protruding portion of the cover member is ground or polished to adjust its shape. At this time, since it is difficult to ground only the protruding portion of the cover member, there is a tendency that a part of the outer surface of the club head main body which part is adjacent to the protruding portion of the cover member is also ground or polished.

on the other hand, it may be desired to apply various surface treatments for improving the appearance of the club head to an area of the sole portion adjacent to the cover member. In such a case, there is a problem such that the surface-treated area is polished when the protruding portion of the cover member is polished. In order to solve such problem, it is conceivable, for example, to cover the surface-treated area with masking tape or the like in order to prevent such area from being polished. However, the masking tape or the like tends to be misaligned or peeled off due to contact with the polishing tool, therefore, it can not be a satisfactory solution to the problem.

The present invention was made in view of the above problems, and an object of the present invention is to provide a golf club head and a manufacturing method therefor, in which the accuracy of surface finishing can be improved.

According to the present invention, a golf club head has a hollow therein and comprises:

a club head main body comprising a crown portion, a sole portion and a back-side outer rim portion extending through therebetween; and a cover member, wherein the club head main body is provided with a crown opening formed in the crown portion, a sole opening formed in the sole portion, and a receiving area formed around at least the sole opening, the receiving area has an outer surface located on the hollow side with respect to a finished outer surface of the golf club head, the cover member integrally includes a crown cover, and a sole cover which extends from the crown cover into the sole portion while turning back, the crown cover closes the crown opening, and the sole cover closes the sole opening and has a peripheral edge portion laid on the outer surface of the receiving area of the club head main body, wherein the sole portion of the club head main body is provided with a shape-changing portion which is convexed toward the outside of the club head or alternatively concaved toward the hollow, the shape-changing portion is formed so that the above-said peripheral edge portion of the sole cover is located between the shape-changing portion and the back-side outer rim portion, the outer surface of the sole portion includes a first region positioned on the opposite side of the shape-changing portion to the back-side outer rim portion, and a second region positioned on the same side of the shape-changing portion as the back-side outer rim portion, and the second region includes a polished area formed from at least a part of the sole cover and at least a part of the club head main body which are polished.

In the golf club head according to the present invention, the shape-changing portion may be convexed toward the outside of the club head.

The shape-changing portion may be concaved toward the hollow.

The shape-changing portion may include a first portion extending along the above-said peripheral edge portion of the sole cover.

The cover member may be made of a fiber reinforced plastic.

The above-said peripheral edge portion of the sole cover may be adhered to the receiving area with an adhesive agent.

The first region may be surface-treated.

The above-said polished area may extend to the shape-changing portion.

A method of manufacturing the golf club head as described above comprises:

a preparation step of preparing the club head main body and the cover member;

a fixing step of fixing the peripheral edge portion of the sole cover of the cover member to the receiving area of the club head main body;

a polishing step of obtaining a polished area in which the peripheral edge portion of the sole cover and the club head main body are flush with each other by making polishing after the fixing step.

In the polishing step, both the peripheral edge portion of the sole cover and the club head main body may be polished.

In the present invention, since the above configurations and the like are adopted, it is possible to provide a golf club head and a method for manufacturing the same, which can improve the accuracy of surface finishing.

DESCRIPTION OF THE PREFERRED EMBODIMENTS

Figure 1:
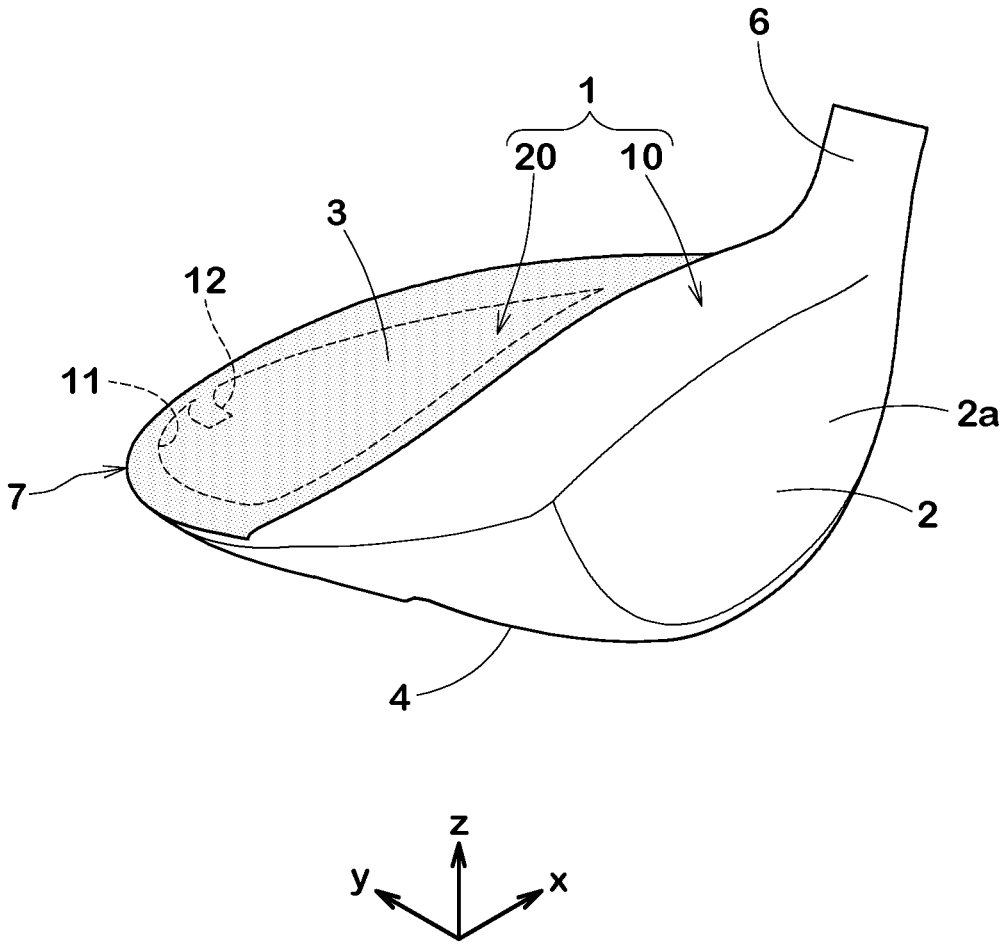
FIG. 1 is a perspective view of a golf club head as an embodiment of the present invention.

Hereinafter, embodiments of the present invention will be described with reference to the drawings.

The specific configurations detailed below in the embodiments and shown in the drawings are for understanding the subject matter of the present invention, and the present invention is not limited to the specific configurations shown. It should be understood that, in the following description, the same or common elements are given the same reference numerals, and redundant descriptions are omitted.

FIGS. 1 to 6 respectively show a perspective view, a top view, a side view, a rear view, a bottom view, and an exploded perspective view of a golf club head 1 as an embodiment of the present invention. Further, FIGS. 1 to 6 show the club head 1 under its reference state.

[Head Reference State]

In this application including the description and claims, dimensions, positions, directions and the like relating to the club head refer to those under a reference state of the club head unless otherwise noted.

Figure 2:
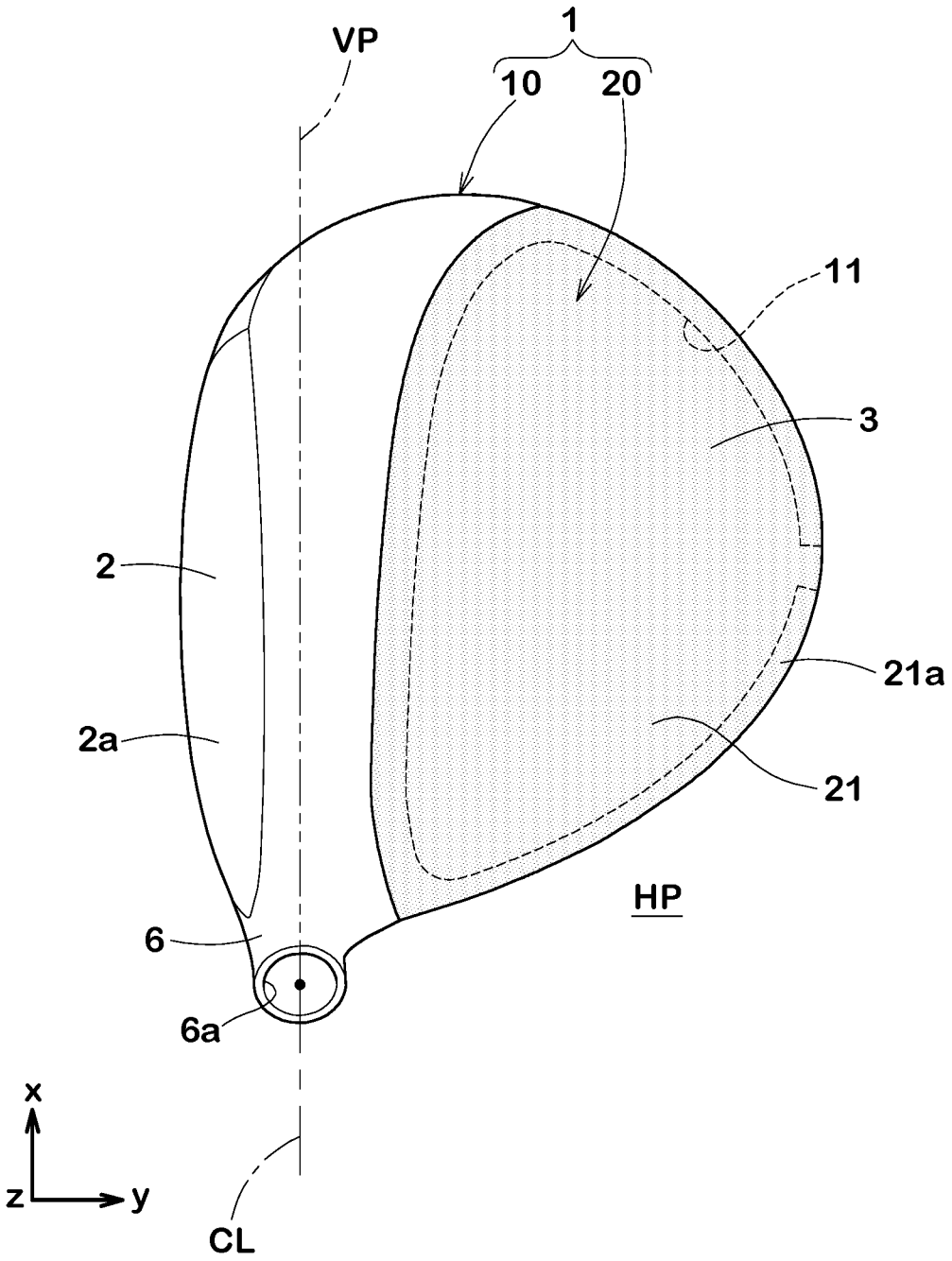
FIG. 2 is a top view of the golf club head.
Figure 3:
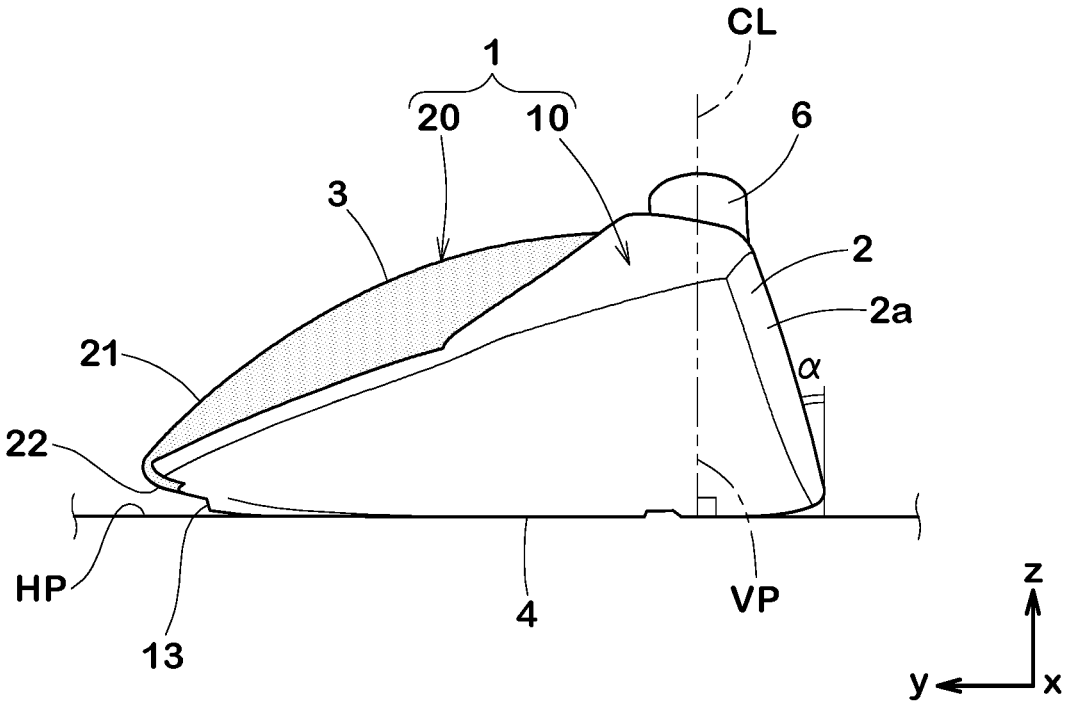
FIG. 3 is a side view of the golf club head as viewed from the toe side of the club head.
Figure 4:
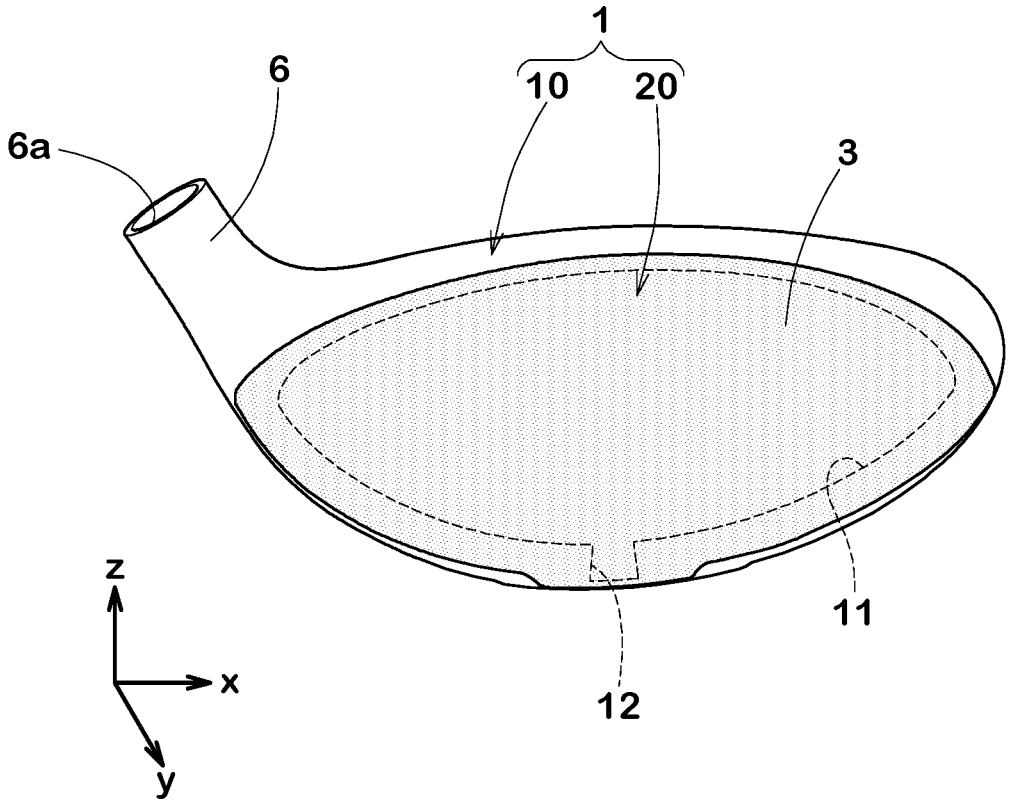
FIG. 4 is a rear view of the golf club head.

Here, the reference state of a club head is such that the club head is set on a horizontal plane HP as shown in FIG. 3 so that the axis CL of the club shaft (not shown) is inclined at the specified lie angle (not shown) while keeping the axis on a vertical plane VP as shown in FIG. 2, and the face forms the specified loft angle alpha as shown in FIG. 3.

Incidentally, in the case of the club head alone, the center line of the shaft inserting hole can be used instead of the axis cl of the club shaft.

[Directions about the Club Head]

In this application, three orthogonal directions are defied in connection with the club head 1 under the reference state as follows.

The toe-heel direction of the club head is a direction x parallel with the horizontal plane HP and the vertical plane VP.

The front-rear direction of the club head is a direction y orthogonal to the vertical plane VP. In the front-rear direction of the club head, the face portion 2 side is the front side, and the opposite side is the rear side (also referred to as the back side).

The up-down direction of the club head is a direction z orthogonal to both the directions x and y.

[Basic Configuration of the Club Head]

In FIGS. 1 to 6, the club head 1 in the present embodiment has a hollow (i) therein (FIG. 6) and formed as a wood-type head.

The wood-type head includes a driver (#1) and a fairway wood. The head 1 may be formed as, for example, a utility-type head as long as it has a hollow (i).

The head 1 comprises a face portion 2, a crown portion 3, and a sole portion 4, and these portions are arranged so as to define the hollow (i) therein. The hollow (i) may be filled with, for example, a foamed material, a gel-like material, or the like, if necessary.

[Face Portion]

The face portion 2 is a portion for hitting a ball and is formed on the front side of the club head 1.

The outer surface (front surface) of the face portion 2 constitutes a striking surface 2*a* that comes into contact with the ball. The striking surface 2*a* may be provided with grooves so called score lines extending in the toe-heel direction.

[Crown Portion]

The crown portion 3 extends from the upper edge of the face portion 2 toward the rear of the club head so as to form the upper surface of the club head. The crown portion 3 forms a portion of the club head which can be seen in the top view of the club head as shown in FIG. 2, excluding the face portion 2 and the hosel portion 6.

As shown in FIG. 3, the crown portion 3 is smoothly inclined so as to gradually approach the horizontal plane HP toward the rear of the club head.

Further, on the heel side of the crown portion 3, a hosel portion 6 is provided. The hosel portion 6 is provided with a shaft inserting hole 6*a* into which a club shaft (not shown) is fixed. As described above, the center line of the shaft inserting hole 6*a* can be used instead of the axis cl of the club shaft when determining the reference state.

[Sole Portion]

Figure 5:
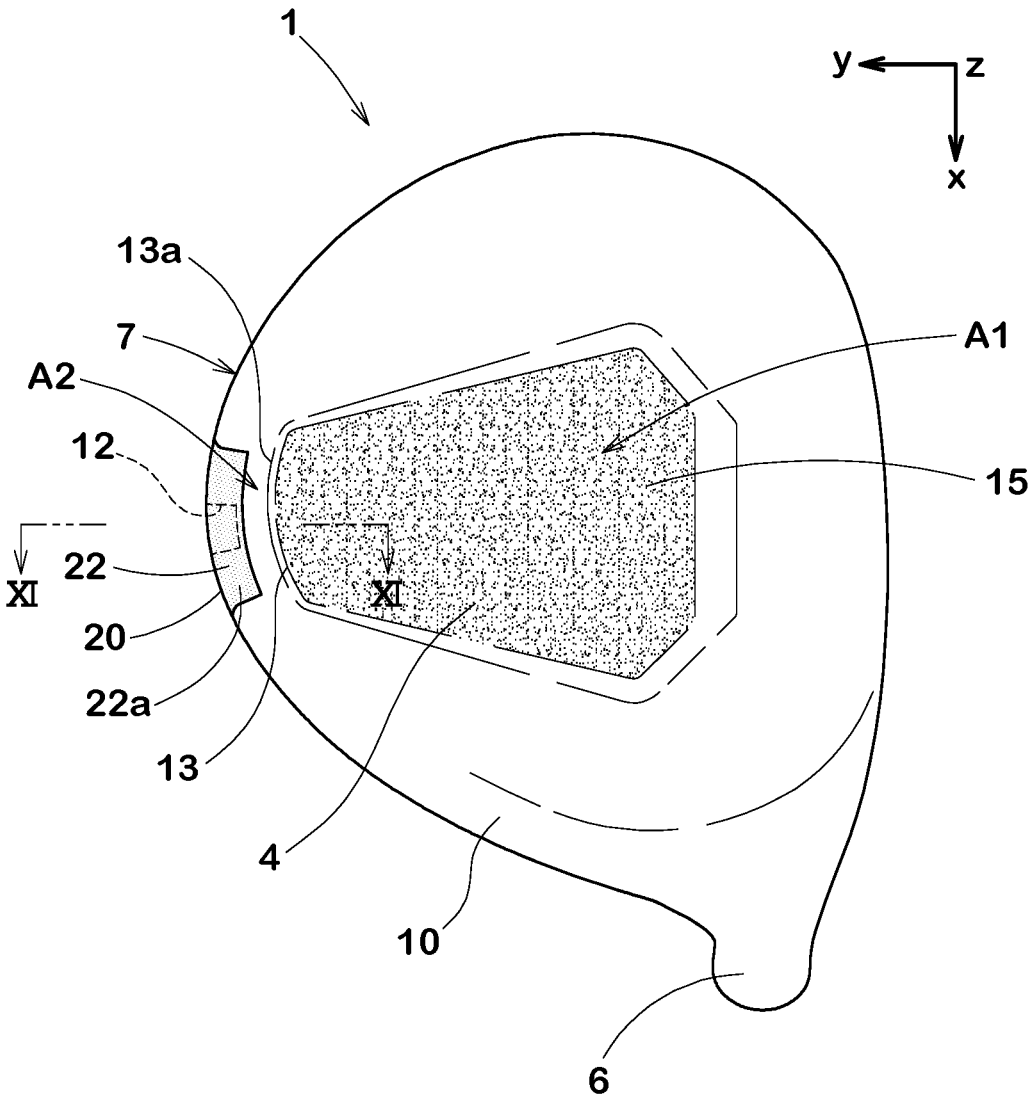
FIG. 5 is a bottom view of the golf club head.

The sole portion 4 extends from the lower edge of the face portion 2 toward the rear of the club head so as to form the bottom surface of the club head. The sole portion 4 forms a portion of the club head which can be seen in the bottom view of the club head as shown in FIG. 5, excluding the hosel portion 6. In this embodiment, the rear side of the sole portion 4 is gradually curved upward and connected to the crown portion 3 as shown in FIG. 3. And, as can be seen from FIG. 3, the crown portion 3 and the sole portion 4 are directly connected.

In this embodiment, the club head 1 is composed of a club head main body 10 and a cover member 20.

[Club Head Main Body]

The club head main body 10 in the present embodiment constitutes a framework of the club head 1, and is made of a metal material. The metal material is not particularly limited, but for example, a titanium alloy, stainless steel or the like is preferred. The club head main body 10 in this embodiment is made of a titanium alloy.

Figure 7:
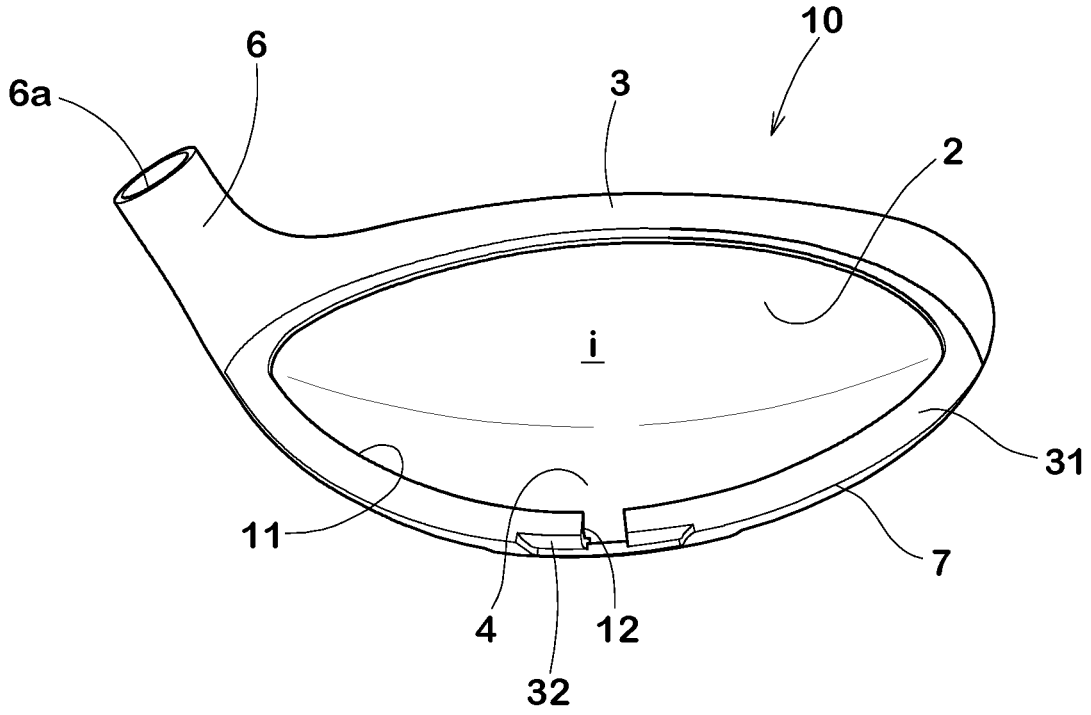
FIG. 7 is a rear view of a club head main body of this embodiment.
Figure 8:
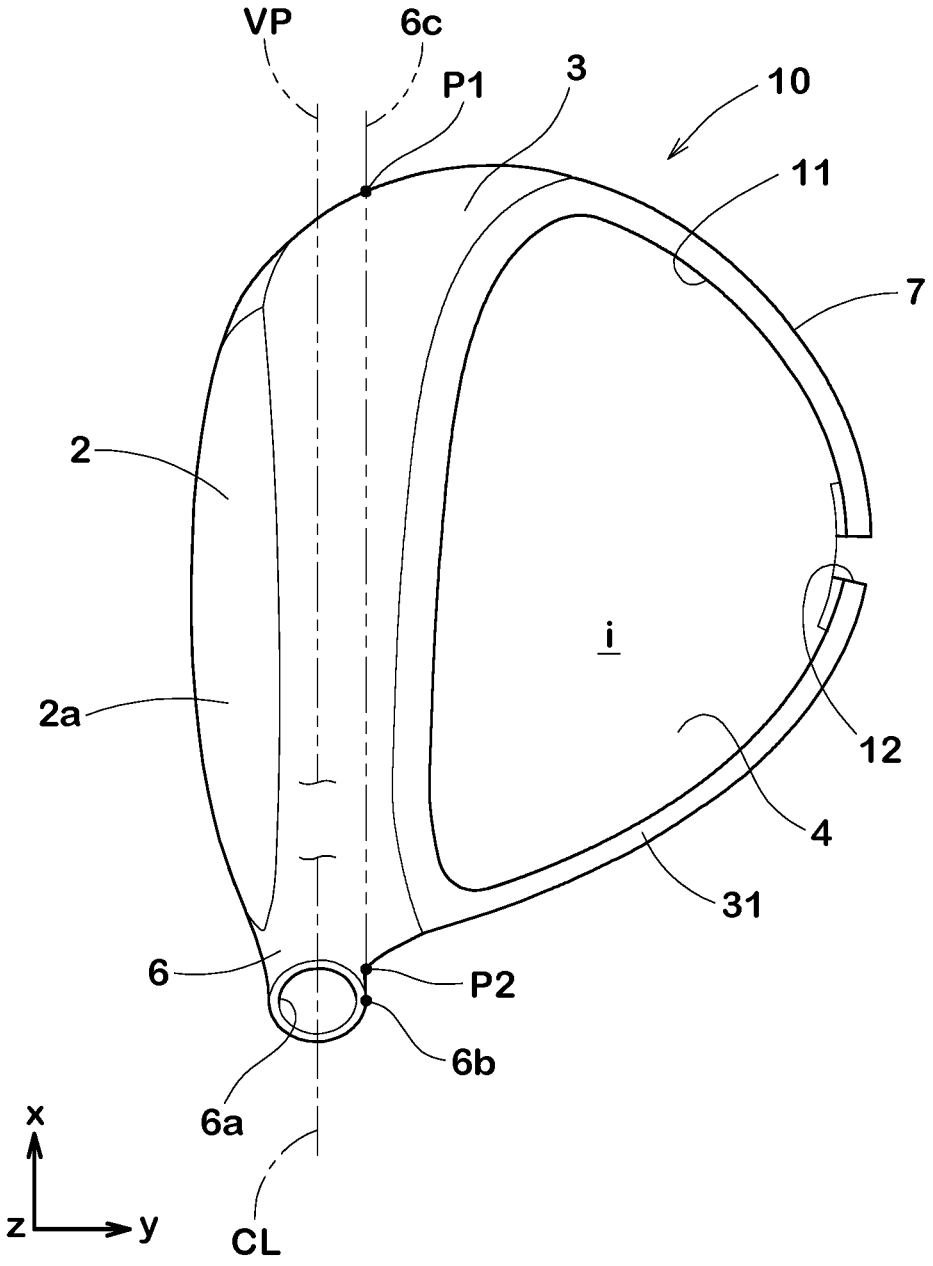
FIG. 8 is a plan view of the club head main body.
Figure 9:
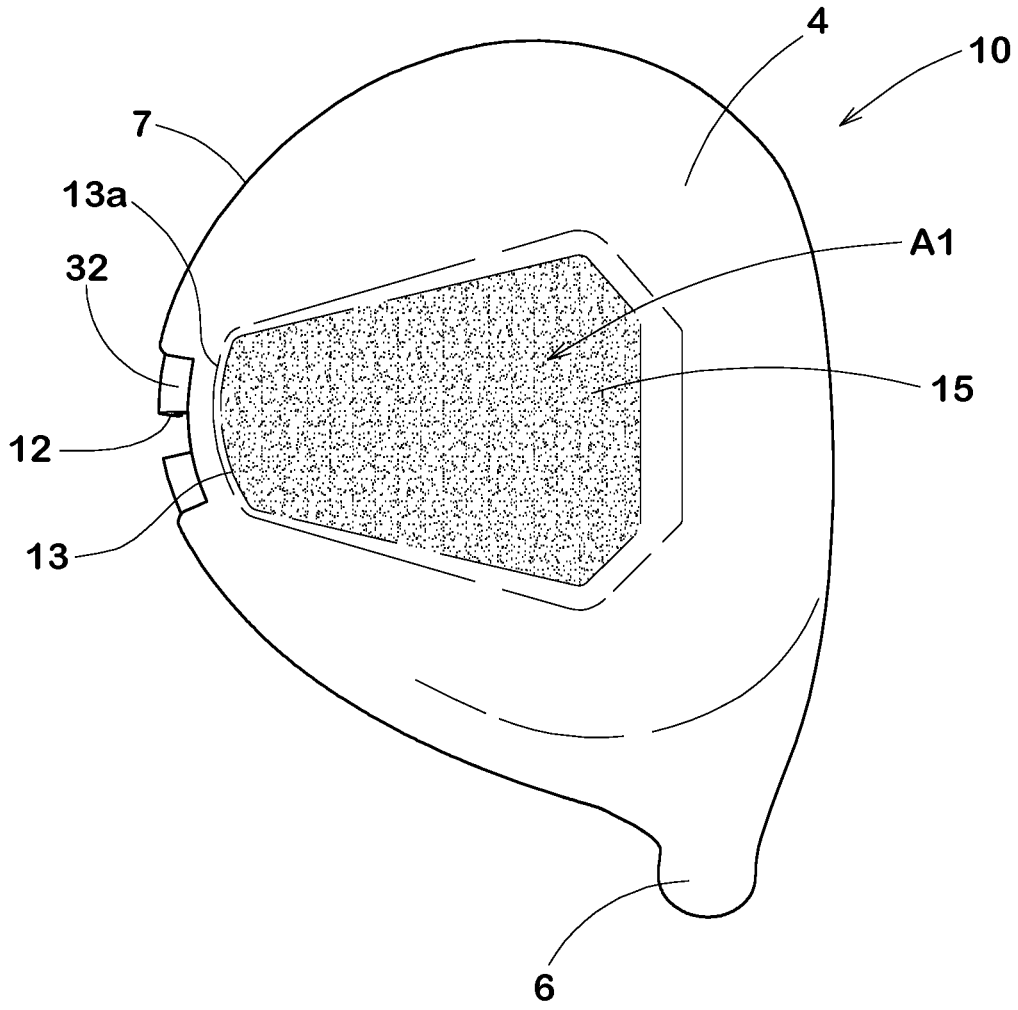
FIG. 9 is a bottom view of the club head main body.

FIGS. 7 to 9 show a rear view, a top view, and a bottom view, respectively, of the club head main body 10.

As shown, the club head main body 10 comprises the face portion 2, the crown portion 3, the sole portion 4, and a back-side outer rim portion 7.

[Back-Side Outer Rim Portion]

As shown in FIG. 8, the back-side outer rim portion 7 extends from the toe side to the heel side of the face portion 2 through between the crown portion 3 and the sole portion 4.

In the present embodiment, the back-side outer rim portion 7 defines a contour of the club head 1 which is, in the top view of the club head, on the rear side of the hosel portion 6. Here, the rear side of the hosel portion 6 means the rear side than the rearmost position 6*b* on the upper end surface of the hosel portion 6 as shown in FIG. 8.

For ease of understanding, in FIG. 8, there are shown a hosel rear line 6*c* which extends in the toe-heel direction through the rearmost position 6*b* on the upper end surface of the hosel portion 6, and intersections P1 and P2 of the hosel rear line 6*c* with the contour line of the club head.

The back-side outer rim portion 7 in the present embodiment is a portion extending from the toe-side intersection P1 to the heel-side intersection P2 which are of the hosel rear line 6*c* with the club head contour line as described above.

Further, the back-side outer rim portion 7 is a connecting portion of two head components: the crown portion 3 and the sole portion 4, which extend in different directions. Therefore, the back-side outer rim portion 7 inherently has high rigidity.

In the top view shown in FIG. 8, the back-side outer rim portion 7 in the present embodiment is curved so as to have an arcuate contour bulging toward the back side of the club head.

The club head main body 10 is provided with a crown opening 11 and a sole opening 12.

[Crown Opening]

As shown in FIG. 8, the crown opening 11 is an opening formed in the crown portion 3. Therefore, a part of the crown portion 3 is formed in the club head main body 10.

The contour shape of the crown opening 11 is not particularly limited, and various shapes may be adopted.

The crown opening 11 in the present embodiment is entirely located within the crown portion 3, and only one crown opening 11 is formed within the crown portion 3.

The rearmost side of the crown opening 11 is opened in the back-side outer rim portion 7.

The crown opening 11 can reduce the mass of the crown portion 3 and produces a weight margin available for designing the center of gravity of the club head.

In order to obtain a larger weight margin, it is preferred that the crown opening 11 occupies at least 50%, more preferably at least 60% of the surface area of the crown portion 3.

For convenience, the surface area of the crown portion 3 is the area defined by the above-mentioned hosel rear line 6*c* and the back-side outer rim portion 7 in FIG. 8.

[Sole Opening]

As shown in FIGS. 7 and 9, the sole opening 12 is an opening formed in the sole portion 4.

Therefore, the club head main body 10 includes a part of the sole portion 4 of the club head 1 excluding the sole opening 12. The contour shape of the sole opening 12 is not particularly limited, and various shapes may be adopted.

In the present embodiment, only one sole opening 12 is formed in the sole portion 4, and the rearmost side of the sole opening 12 is opened in the back-side outer rim portion 7.

The sole opening 12 of the present embodiment is formed smaller than the crown opening 11, but the sole opening is not limited to such example.

Figure 10:
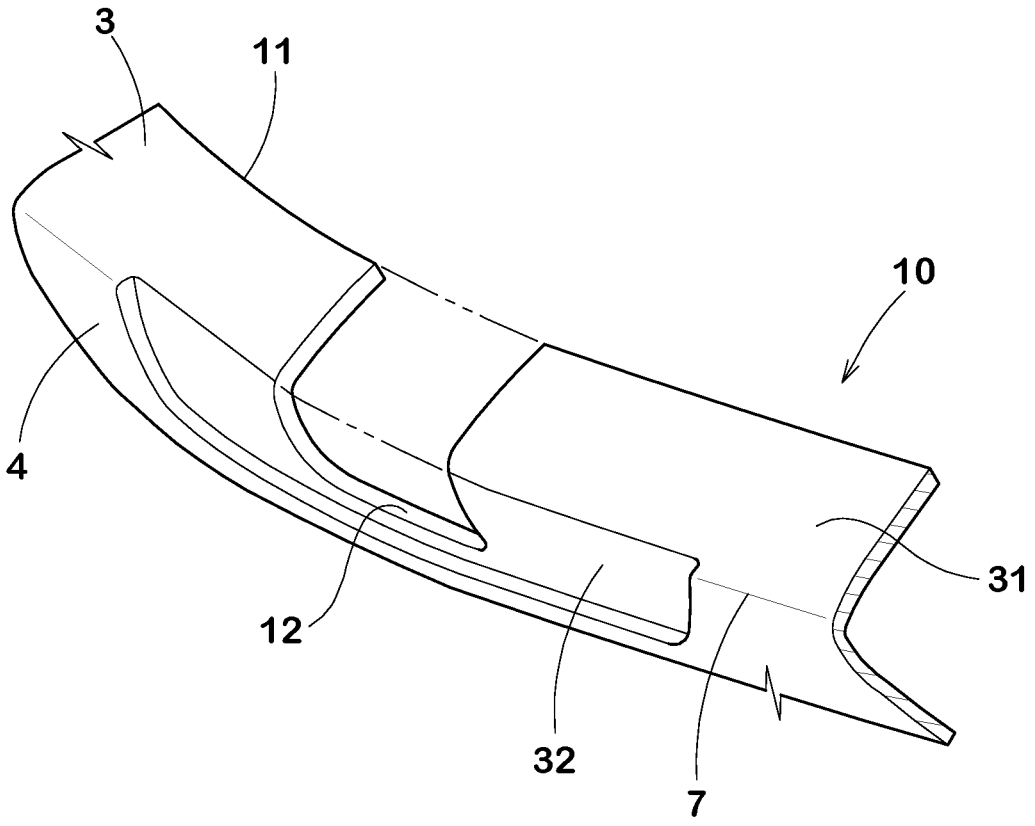
FIG. 10 is a perspective partial view of the club head main body as viewed from the rear side of the club head.

FIG. 10 is a perspective partial view of the club head main body 10 as viewed from the rear side of the club head.

As shown, in this embodiment, the crown opening 11 and the sole opening 12 are connected with each other in the back-side outer rim portion 7. In other embodiments, the sole opening 12 may be separated from the crown opening 11.

Further, in the present embodiment, the crown opening 11 and the sole opening 12 communicate with each other at the rearmost position of the back-side outer rim portion 7, but these openings 11 and 12 may be formed so as to communicate with each other at other position.

[Shape-Changing Portion]

Figure 11:
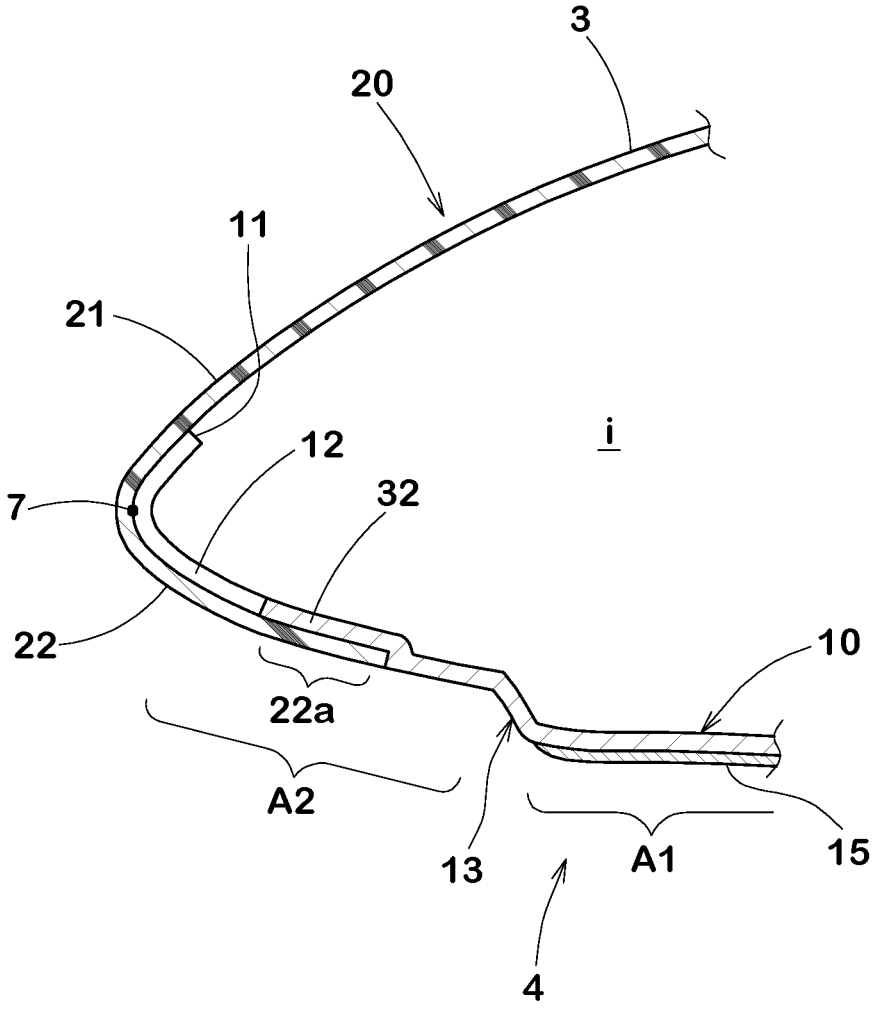
FIG. 11 is a cross-sectional view taken along line xi-xi of FIG. 5.
Figure 12:
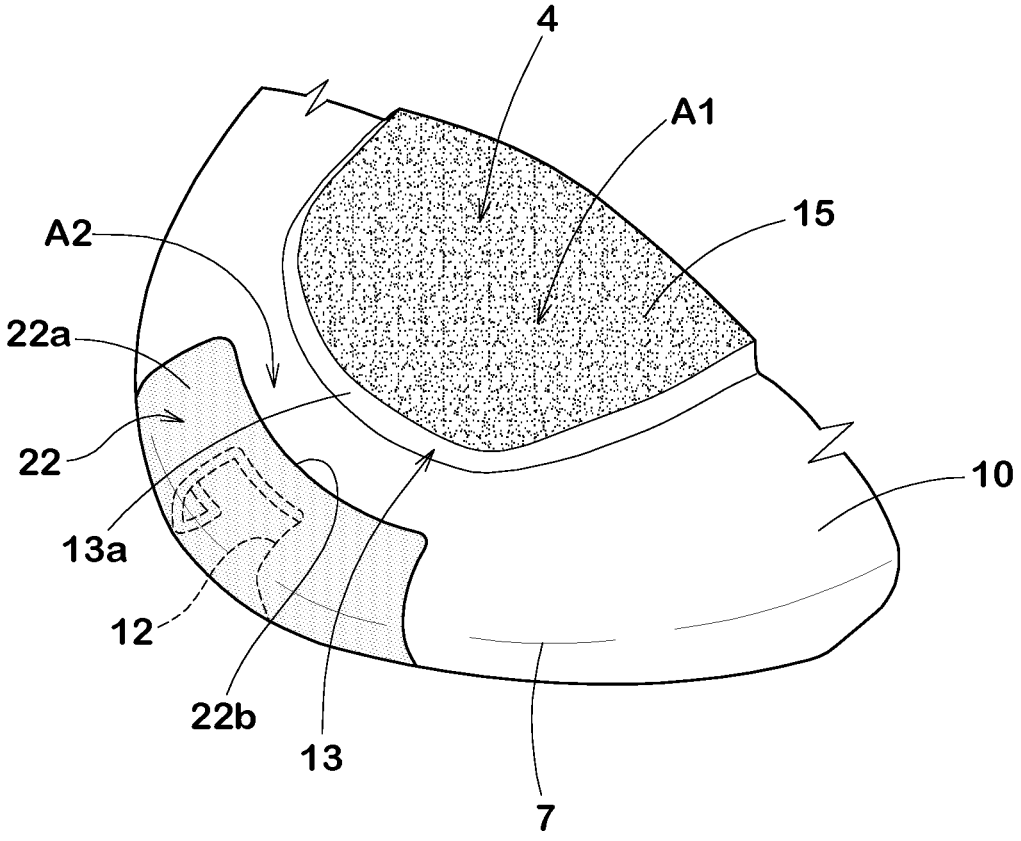
FIG. 12 is a perspective partial view of the golf club head as viewed from the rear side and bottom side of the club head.
Figure 13:
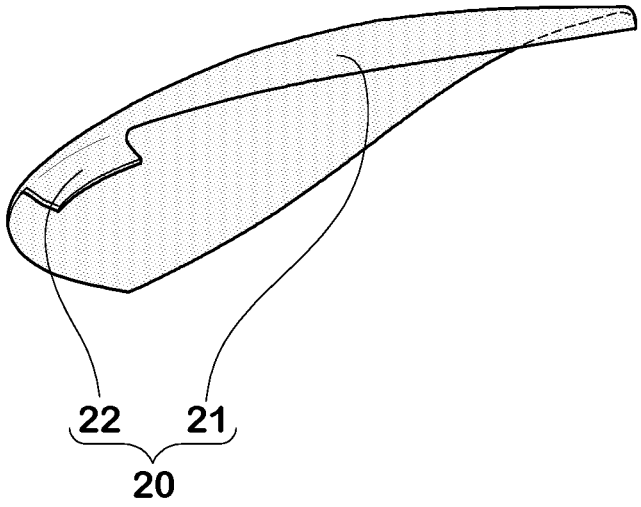
FIG. 13 is a perspective view of a cover member of this embodiment.
Figure 14:
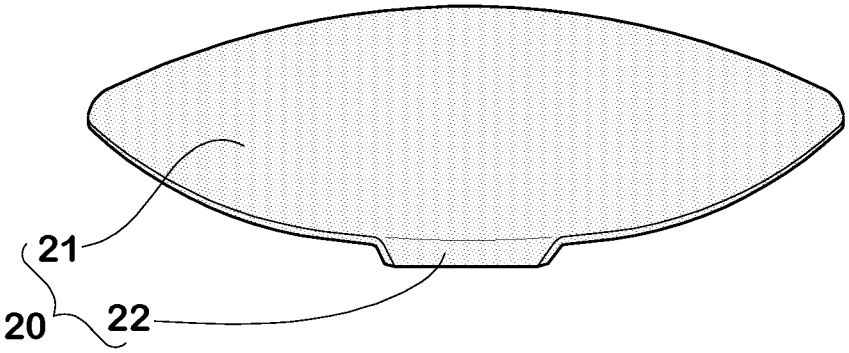
FIG. 14 is a rear view of the cover member.
Figure 15:
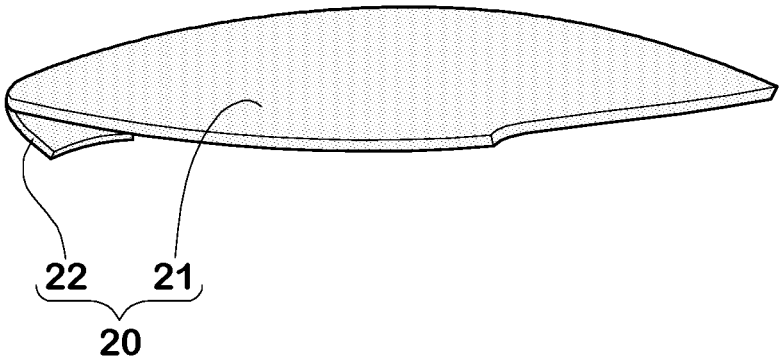
FIG. 15 is a side view of the cover member.

FIG. 11 is a cross-sectional view taken along line xi-xi of FIG. 5. FIG. 12 is a perspective partial view of the golf club head 1 as viewed from the rear side and bottom side of the club head.

As shown in FIGS. 11 and 12, a shape-changing portion 13 is formed in a sole portion of the club head main body 10. Here, the sole portion of the club head main body 10 corresponds to the sole portion 4 of the club head 1 excluding the undermentioned sole cover 22.

The shape-changing portion 13 of the present embodiment is formed as a convex portion convexed toward the outside of the club head (downward in FIG. 11).

The shape-changing portion 13 can be formed as a concave portion concaved toward the hollow (i).

Details of the shape-changing portion 13 will be described later.

[Cover Member]

FIG. 6 and FIGS. 13 to 15 show the cover member 20. It is desirable that the cover member 20 is made of a material having a specific gravity smaller than that of the club head main body. Although not particularly limited, the cover member 20 is preferably made of a low specific gravity material having a specific gravity of 2.0 or less, for example. As the low specific gravity material, for example, non-metal materials such as fiber reinforced plastics, e.g. carbon fiber reinforced plastics (cFRP) and the like, and low specific gravity metal materials, e.g. aluminum alloys, magnesium alloys and the like are preferably used.

The cover member 20 of the present embodiment is formed as a plate-shaped member made of a carbon fiber reinforced plastic.

since the cover member 20 is made of a material having a small specific gravity, the club head 1 in the present embodiment is reduced in the mass in the crown portion 3, and as a result, the position of the center of gravity of the club head can be lowered. In addition, the lightening of the crown portion can produce a weight margin that can be used for adjusting the position of the center of gravity of head when designing the center of gravity of head 1, and thus the degree of freedom in designing the center of gravity of head 1 is increased.

The cover member 20 of the present embodiment integrally includes a crown cover 21 and a sole cover 22 which extends from the crown cover 21 into the sole portion 4, while turning back toward the front side.

The crown cover 21 has a size and a shape capable of covering at least the crown opening 11 to close the crown opening 11. The sole cover 22 has a shape and a size so as to extend into the sole portion 4 and cover at least the sole opening 12 to close the sole opening 12.

As shown in FIG. 2, the crown cover 21 of the present embodiment has a peripheral edge portion 21*a* slightly and outwardly protrude from the edge (shown by dotted line) of the crown opening 11. The peripheral edge portion 21*a* of the crown cover 21 is laid on the outer surface of a crown portion of the club head main body 10 and fixed thereto by an adhesive agent, for example. Here, the crown portion of the club head main body 10 corresponds to the crown portion 3 of the club head 1 excluding the crown cover 21.

Figure 6:
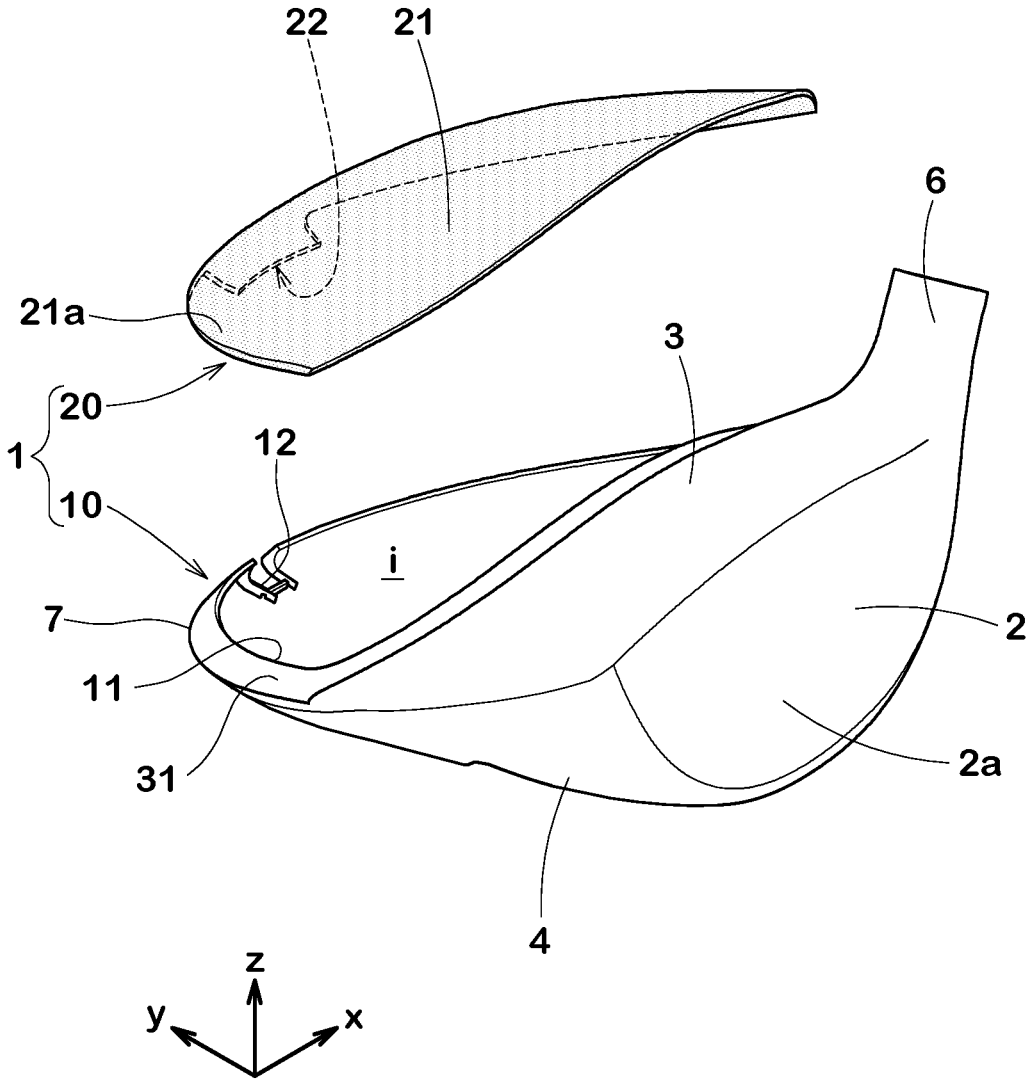
FIG. 6 is an exploded perspective view of the golf club head.

As shown in FIG. 6, the crown portion of the club head main body 10 may be provided with a first receiving area 31 having a shape corresponding to that of the crown cover 21 in order to support the peripheral edge portion 21*a* of the crown cover 21.

The first receiving area 31 is formed at least partially in the around portion of the crown opening 11.

For example, the first receiving area 31 may be formed as a recessed area which is recessed toward the hollow (i) from the finished outer surface of the club head 1. The recessed first receiving area 31 can reduce or eliminate a step between the outer surface of the crown cover 21 and the outer surface of the club head main body 10 which step may be formed when the peripheral edge portion 21*a* of the crown cover 21 is laid on the first receiving area 31. This helps to make these outer surfaces closer to a flush continuous surface.

similarly, as shown in FIG. 5, the sole cover 22 of the present embodiment has a peripheral edge portion 22*a* protruding outwardly from the edge (shown by dotted line) of the sole opening 12. The peripheral edge portion 22*a* of the sole cover 22 is laid on the outer surface of the sole portion of the club head main body 10, and is fixed by using an adhesive agent, for example.

As shown in FIG. 10, the club head main body 10 further comprises a second receiving area 32 formed at least partially in the around portion of the sole opening 12.

The second receiving area 32 is located on the hollow (i) side of the finished outer surface of the club head 1. The second receiving area 32 is preferably formed as a recess, which is recessed toward the hollow (i) from the finished outer surface of the sole portion 4 of the club head, and into which the peripheral edge portion 22*a* of the sole cover 22 is fitted.

[First Region, Second Region (Polished Area)]

As shown in FIG. 5, the outer surface of the sole portion 4 of the club head 1 is provided with a first region A1 and a second region A2.

The first region A1 is a region of the shape-changing portion 13 on the opposite side to the back-side outer rim portion 7 (on the face portion 2 side, in the present embodiment).

In the present embodiment, the finished surface of the first region A1 (the final finished surface visible from the outside) is not polished as a finishing process.

As used herein, "polishing" means a work of continuously or intermittently rubbing a solid surface by an abrasive having a higher hardness than the surface to smooth it.

The first region A1 of the present embodiment is surface-treated.

The surface treatment is not particularly limited. For example, a metal film treatment, a non-metal film treatment, an anodization treatment, a chemical conversion treatment and the like may be employed. In particular, dry plating by a physical vapor deposition method such as PVD and CVD is suitable.

In the present embodiment, the first region A1 is coated with a film 15 formed by ion plating which can form a hard film excellent at the adhesion. Such surface treatment by ion plating is desirable because it enhances the resistance to surface wound of the sole portion 4 which often comes into contact with the ground during swing.

Further, a pretreatment polishing may be applied to the first region A1. Such pretreatment may become not visible from the outside due to the surface treatment applied thereon.

Further, a transfer seal or the like may be applied instead of the surface treatment or after the surface treatment.

on the other hand, the second region A2 is a region on the back-side outer rim portion 7 side (on the rear side in the present embodiment) of the shape-changing portion 13.

The second region A2 includes a polished area formed by at least part of the sole cover 22 which is polished, and at least part of the club head main body 10 which is polished as well. Therefore, the second region A2 has a different surface aspect from the first region A1. The polished area may be left as it is or may be painted.

[Position of Shape-Changing Portion]

As shown in FIG. 11, the shape-changing portion 13 of the present embodiment is formed so that the peripheral edge portion 22*a* of the sole cover 22 is located between the shape-changing portion 13 and the back-side outer rim portion 7.

In other words, the shape-changing portion 13 is located between the first region A1 and the second region A2.

As a result, when polishing the peripheral edge portion 22*a* of the sole cover 22, the presence of the shape-changing portion 13 makes it difficult for the first region A1 to be polished, and makes it easier to polish only the second region A2.

In particular, the outer surface of the peripheral edge portion 22*a* of the sole cover 22 can be made flush with the outer surface of the club head main body 10 without damaging the appearance of the first region A1 by unnecessary polishing. As described above, the club head 1 in the present embodiment can improve the accuracy of surface finishing by polishing.

As shown in FIGS. 5 and 12, the shape-changing portion 13 preferably comprises a first portion 13*a* extending along the front edge 22*b* of the peripheral edge portion 22*a* of the sole cover 22. The first portion 13*a* faces the front edge 22*b* extending along the back-side outer rim portion 7 of the peripheral edge portion 22*a* of the sole cover 22, and the first portion 13*a* extends substantially parallel to the front edge 22*b*.

The polished area preferably extends from the surface of the peripheral edge portion 22*a* of the sole cover 22 to the shape-changing portion 13. Since the polished area and the first region A1 have visually different surface aspects, by matching the boundary between these two areas with the shape-changing portion 13, the boundary can be made inconspicuous. This helps to provide a good appearance for the head 1.

[Method for Manufacturing the Club Head]

Next, a method for manufacturing the club head 1 described above will be described.

In the present embodiment, the method for manufacturing the club head 1 comprises a preparation step S1, a fixing step S2, and a polishing step S3.

In the preparation step, the above-mentioned head main body 10 and cover member 20 are prepared (manufactured).

The club head main body 10 is manufactured by integrally molding all the portions by casting, for example.

The cover member 20 is manufactured, for example, by molding a fiber/resin composite material in which fibers are impregnated with an uncured resin, into a predetermined shape using a mold or the like, and then curing the molded material.

In the fixing step, the club head main body 10 and the cover member 20 obtained in the preparation step are fixed to each other.

In the fixing step in this embodiment, by the use of an adhesive agent, the cover member 20 is fixed to the club head main body 10. The peripheral edge portion 22*a* of the sole cover 22 of the cover member 20 is fixed to the second receiving area 32 of the club head main body 10. And the peripheral edge portion 21*a* of the crown cover 21 of the cover member 20 is fixed to the first receiving area 31 of the club head main body 10.

In the polishing step, the peripheral edge portion 22*a* of the sole cover 22 and the club head main body 10 are polished so as to be flush with each other.

Figure 16:
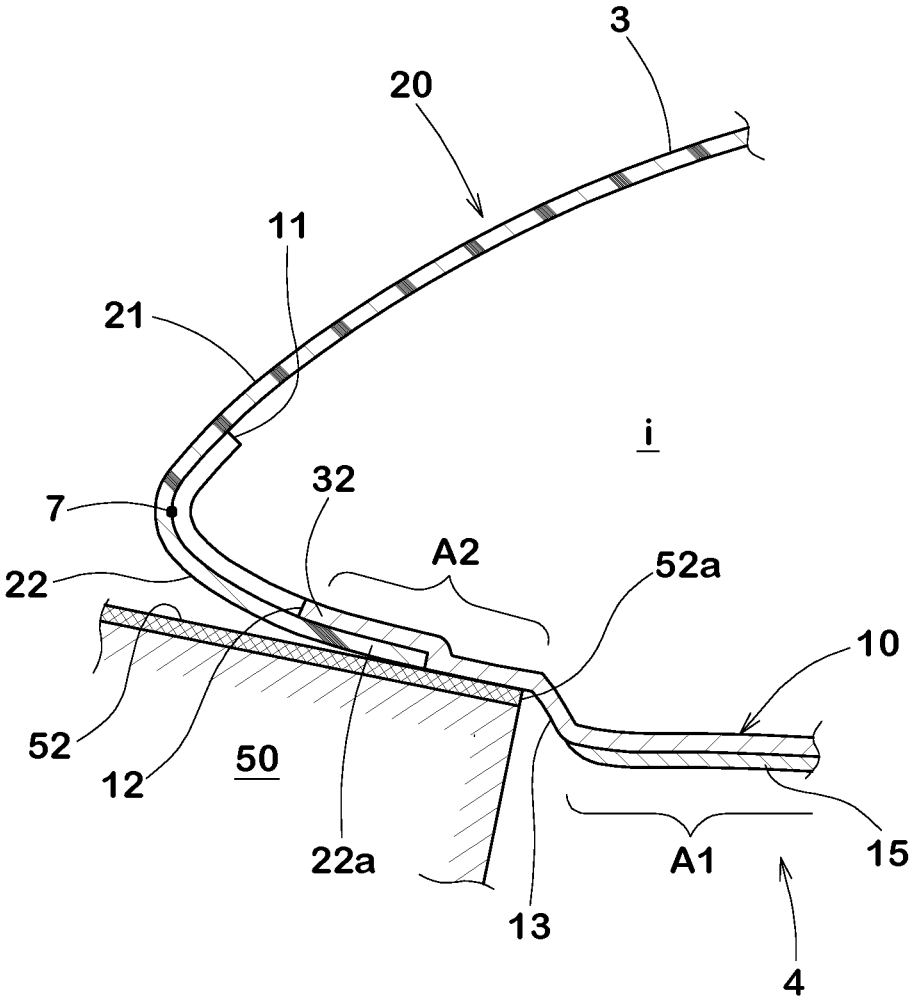
FIG. 16 is a cross-sectional partial view of the golf club head for explaining a polishing process of a manufacturing method of the present embodiment.

FIG. 16 shows an example of the polishing step in which the polishing is carried out by the use of a polishing tool 50. In this example, the polishing tool 50 is a belt sander having a polishing belt 52, and abrasive grains are fixed to the surface of the polishing belt 52. The polishing belt 52 is configured to move continuously in a predetermined direction.

In the example shown in FIG. 16, the polishing belt 52 is in contact with the club head 1 while moving in a direction orthogonal to the paper surface (FIG. 16), for example. By contacting the polishing belt 52 with the outer surface of the peripheral edge portion 22*a* of the sole cover 22 and the club head main body 10 around it, both of them are polished. Specifically, the outer surfaces of the peripheral edge portion 22*a* and the club head main body 10 of the sole cover 22 are polished so as to become flush with each other. Thus, a polished area is formed.

In this embodiment, the shape-changing portion 13 is formed to be convex on the outer surface of the sole portion 4. Therefore, if the polishing tool 50 is excessively moved toward the shape-changing portion 13, the side edge 52*a* of the polishing belt 52 comes into contact with the shape-changing portion 13, and the shape-changing portion 13 resists further movement of the polishing belt 52 toward the shape-changing portion 13. This draws attention to the worker, and effectively prevents the first region A1 from being polished by the polishing tool 50. From this point of view, when the shape-changing portion 13 is formed to be convex, the protruding height thereof is not less than 0.5 mm, preferably not less than 1.0 mm, more preferably not less than 1.5 mm, still more preferably not less than 2.0 mm.

[Another Example of Shape-Changing Portion]

Figure 17:
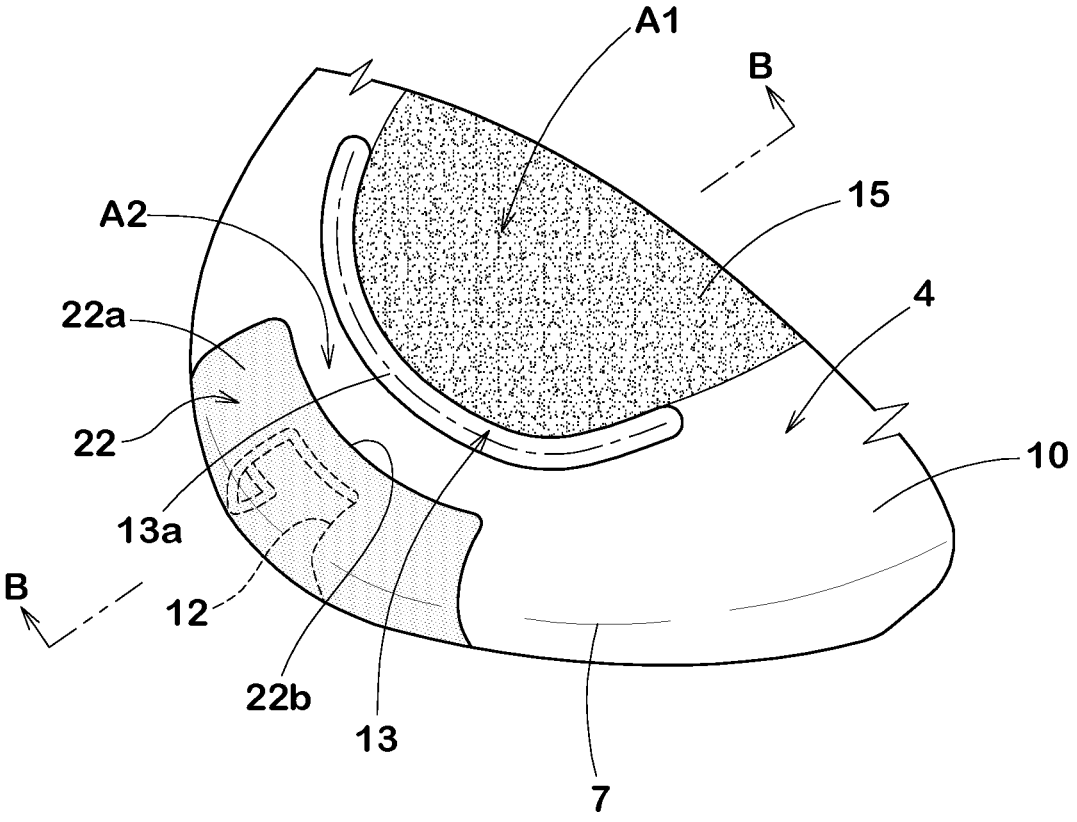
FIG. 17 is a perspective partial view of a golf club head as another embodiment of the present invention as viewed from the rear side and bottom side of the club head.
Figure 18:
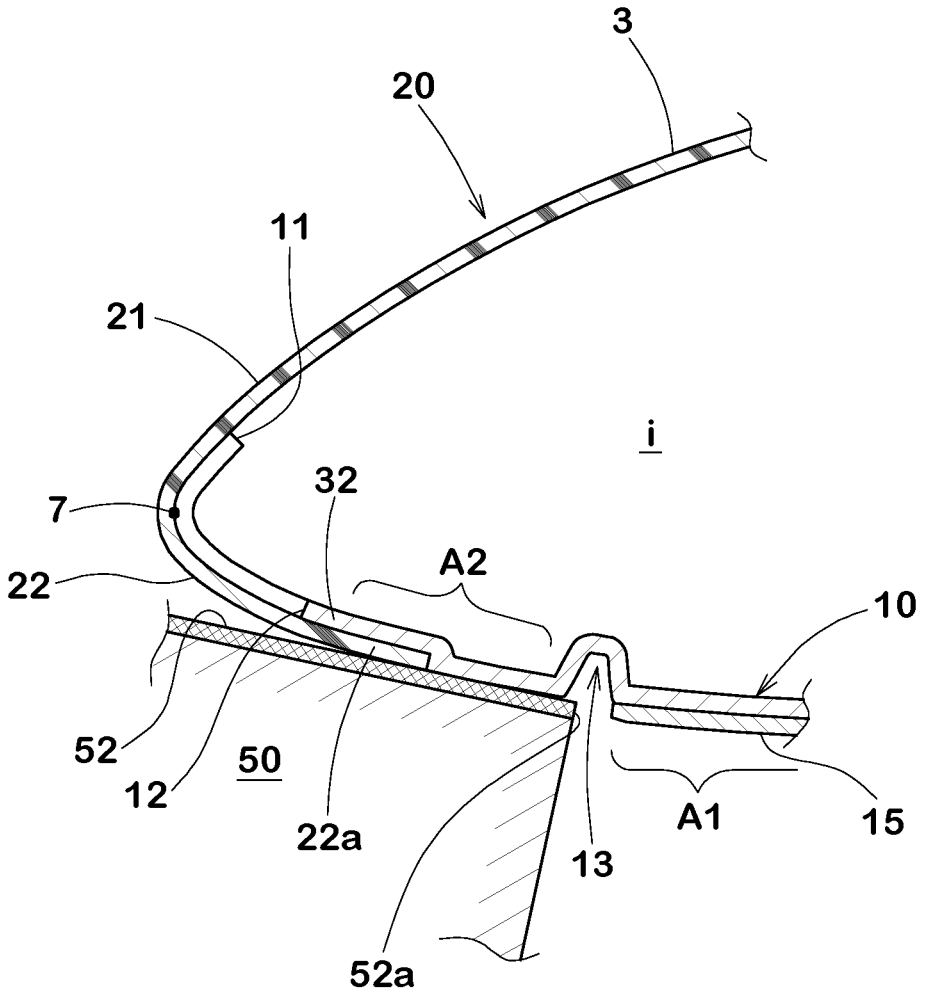
FIG. 18 is a cross-sectional partial view of the golf club head shown in FIG. 17 for explaining the polishing process.
Figure 19:
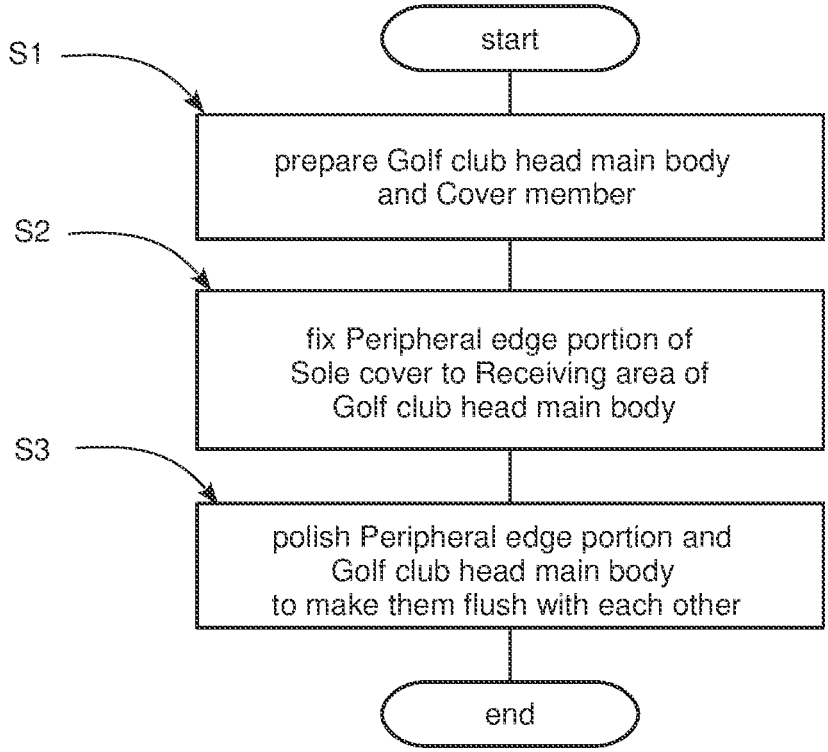
FIG. 19 is a flow chart of a method of manufacturing the golf club head according to the present invention.

FIG. 17 is a perspective partial view of a golf club head 1 as another embodiment of the present invention as viewed from the rear side and bottom surface side of the club head in order to explain another example of the shape-changing portion 13. FIG. 18 is a cross-sectional view taken along line B-B of FIG. 17 and shows a polishing step.

As shown in FIGS. 17 and 18, the shape-changing portion 13 in this embodiment is a concave portion concaved toward the hollow (i) and formed in the form of a groove. This shape-changing portion 13 also comprises the first portion 13*a*. The first portion 13*a* faces the edge 22*b* extending along the back-side outer rim portion 7 of the peripheral edge portion 22*a* of the sole cover 22, and the first portion 13*a* extends substantially parallel to the edge 22*b*.

Even in such example as shown in FIG. 18, in the polishing step, the polishing belt 52 is brought into contact with the outer surface of the peripheral edge portion 22*a* of the sole cover 22 and the club head main body 10, and these are polished to form a polished area.

In this embodiment, since the groove-shaped concave shape-changing portion 13 is formed between the second region A2 and the first region A1, if the polishing tool 50 has moved excessively toward the shape-changing portion 13, the first region A1 can be prevented from being polished. That is, the side edge 52*a* of the polishing belt 52 makes non-contact rotation at the groove-shaped concave shape-changing portion 13, and is prevented from contacting with the first region A1. From this point of view, when the shape-changing portion 13 is formed as a concave portion, its depth and groove width are set to be not less than 0.5 mm, preferably not less than 1.0 mm, more preferably not less than 1.5 mm, still more preferably not less than 2.0 mm.

In this embodiment, the shape-changing portion 13 is formed as the concave portion in the form of a groove having a relatively small width, but the concave portion may be extended widely toward the face portion 2.

Further, in each embodiment, a masking tape or the like may be supplementary used to cover the first region A1 prior to conducting the polishing step.

Further, as another embodiment, the first region A1 in the embodiment shown in FIGS. 17 and 18 may be formed so as to be more convex than the second region A2. In such embodiment, the accuracy of the surface finish of the club head 1 can be further improved.

while detailed description has been made of preferable embodiments of the present invention, the present invention can be embodied in various forms without being limited to the illustrated embodiments. In addition, the present invention can be embodied so that an embodiment includes the characteristic features of the above-disclosed embodiments. Furthermore, it goes without saying that the present invention includes equivalents of the above-disclosed embodiments.

REFERENCE SIGNS LIST

1 head
2 face portion
3 crown portion
4 sole portion
7 back-side outer rim portion
10 head main body
11 crown opening
12 sole opening
13 shape-changing portion
20 cover member
21 crown cover
21*a* peripheral edge portion of crown cover
22 sole cover
22*a* peripheral edge portion of sole cover
31 first receiving area
32 second receiving area
A1 first region
A2 second region
i hollow

The invention claimed is:

1. A golf club head having a hollow space therein and comprising a main body and a cover member, wherein the main body includes a crown portion, a sole portion and a back-side outer rim portion of the golf club head, the back-side outer rim portion extending between the crown portion and the sole portion, wherein the main body is provided with a crown opening formed in the crown portion, a sole opening formed in the sole portion, and a receiving area formed around at least the sole opening, wherein the receiving area has an outer surface located in the hollow space as opposed to a finished outer surface of the golf club head, wherein the cover member integrally includes a crown cover, a sole cover which extends from the crown cover into the sole portion, while extending towards a front side of the gold club head, the crown cover closes the crown opening, the sole cover closes the sole opening, and has a peripheral edge portion laid on said outer surface of the receiving area, wherein the sole portion of the main body is provided with a shape-changing portion so that the peripheral edge portion of the sole cover is located between the shape-changing portion and the back-side outer rim portion, and the sole portion has an outer surface which forms the finished outer surface of the golf club head and includes:

a first region positioned on a side of the shape-changing portion opposite to the back-side outer rim portion, and a second region positioned on a side of the shape-changing portion which is the same as the back-side outer rim portion, wherein the second region includes a polished area formed from at least a part of the sole cover and at least a part of the main body which are both polished, wherein the shape-changing portion is convexed toward an outside of the golf club head or alternatively concaved toward the hollow space, the convexed shape-changing portion includes a first step portion extending along the sole cover peripheral edge portion, wherein the first step portion forms a surface inclined with respect to the second region and extending between the first region and the second region so as to form a step between the first region and the second region, and the concaved shape-changing portion includes a first groove portion extending along the peripheral edge portion of the sole cover, wherein the first groove portion is a groove which forms a gap between the first region and the second region.

2. The golf club head according to claim 1, wherein the cover member is made of a fiber reinforced plastic.

3. The golf club head according to claim 2, wherein the peripheral edge portion of the sole cover is adhered to the receiving area with an adhesive agent.

4. The golf club head according to claim 1, wherein the peripheral edge portion of the sole cover is adhered to the receiving area with an adhesive agent.

5. The golf club head according to claim 1, wherein the first region is surface-treated.

6. The golf club head according to claim 5, wherein the polished area extends to the shape-changing portion.

7. The golf club head according to claim 1, wherein the polished area extends to the shape-changing portion.

8. A method of manufacturing the golf club head according to claim 1, comprising:

a preparation step of preparing the main body and the cover member;

a fixing step of fixing the peripheral edge portion of the sole cover of the cover member to the receiving area of the main body; and after the fixing step, a polishing step of obtaining the polished area of the second region in which the peripheral edge portion of the sole cover and the main body are flush with each other.

9. The method according to claim 8, wherein in the polishing step, both the peripheral edge portion of the sole cover and the main body are polished.

* * * * *